US007205494B2

(12) United States Patent
Misaki et al.

(10) Patent No.: US 7,205,494 B2
(45) Date of Patent: Apr. 17, 2007

(54) SWITCHING DEVICE

(75) Inventors: Shinji Misaki, Tokyo (JP); Makoto Umekawa, Hyogo (JP); Keishi Fujii, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/543,780

(22) PCT Filed: Oct. 27, 2004

(86) PCT No.: PCT/JP2004/015936

§ 371 (c)(1),
(2), (4) Date: Jul. 29, 2005

(87) PCT Pub. No.: WO2005/057600

PCT Pub. Date: Jun. 23, 2005

(65) Prior Publication Data

US 2006/0054483 A1 Mar. 16, 2006

(30) Foreign Application Priority Data

Dec. 9, 2003 (JP) ..... 2003-410643

(51) Int. Cl.
*H01H 9/02* (2006.01)

(52) U.S. Cl. ..... 200/314; 200/310

(58) Field of Classification Search ..... 200/308–317, 200/341–345
See application file for complete search history.

(56) References Cited

U.S. PATENT DOCUMENTS 4,163,883 A * 8/1979 Boulanger ..... 200/314
4,778,952 A * 10/1988 Watkins et al. ..... 200/5 A
5,718,326 A * 2/1998 Larose et al. ..... 200/314

FOREIGN PATENT DOCUMENTS

JP 63-31443 Y2 8/1988
JP 6-33335 U 4/1994
JP 6-31616 Y2 8/1994
JP 2003-252538 A 9/2003

* cited by examiner

*Primary Examiner*—Elvin Enad
*Assistant Examiner*—M. Fishman
(74) *Attorney, Agent, or Firm*—Sughrue Mion, PLLC

(57) ABSTRACT

A switching device includes a light emitting unit 11 for applying light to an operational button 1 having a side that is supported by a hinge 3 so that the operational button can shake is arranged in the vicinity of the hinge, and a light diffusion prism member 5 for diffusively reflecting the light emitted out of the light emitting unit 11 toward the operational button 1. As a result, a downsizing of the whole of the switching device can be achieved, and the switching device is suitable for providing uniform brightness over the whole surface of the operational button without any unevenness of the brightness of the operational button.

8 Claims, 3 Drawing Sheets

SWITCHING DEVICE

FIELD OF THE INVENTION

The present invention relates to a button switching device using a hinge, which is used for switching equipment mounted in vehicle-mounted audio equipment such as a car audio apparatus.

BACKGROUND OF THE INVENTION

Such a related art switching device is constructed so that an operational button made of transparent synthetic resin, on which a character string, a sign, or the like is marked, is secured to a surface of a shaking plate, an assembly in which a side of the shaking plate is supported by a holder via a hinge formed of an elastic piece so that the shaking plate can shake is built into a face panel of vehicle-mounted audio equipment, the operational button is exposed to the cabin of a vehicle via an opening formed in the face panel, a projecting portion used for driving the switching device is formed on a back surface of the shaking plate and on another side of the shaking plate, and a light source for illuminating the operational button and a switch which is driven when pressed by the projecting portion used for driving the switching device are arranged behind the back surface of the operational button.

Next, the operation of the related art switching device will be explained.

The operational button is always illuminated directly by the light source, and, when the operational button is pushed in order to drive the switching device, the shaking plate shakes while being inclined somewhat because one side of the shaking plate is supported by the hinge, and the projecting portion disposed on the other side of the shaking plate presses and drives the switch.

In accordance with patent reference 1 which discloses a related art, there is provided a pushbutton switch for use in elevators, including a key-top portion attached to a wall surface so that it is exposed at least the surface of the wall, a light guiding plate secured to this key-top portion, for reflecting light incident thereupon toward the key-top portion, a buffer mechanism for supporting the key-top portion and the light guiding plate so that they can always move in parallel to the surface of the wall, a light emitting unit for applying light to a lateral surface of the light guiding plate which is placed opposite to the lateral surface of the light guiding plate, a switching body for bringing the light emitting unit into a lighting state when the light guiding plate is brought into contact therewith, and a circuit board on which this switching body, the light emitting unit, and a guide member are arranged, a contact surface of the light guiding plate being in contact with the switching body and serving as a reflecting surface for reflecting the light from the light emitting unit toward the key-top portion.

Patent reference 1: JP,2003-252538,A

Since the operational button is directly illuminated by the light source arranged in the back thereof in the related art switching device, the light emitted out of the light source does not spread while unevenness develops in the brightness of the surface of the operational button when the distance between the operational button and the light source is too short. It is necessary to leave some distance between the operational button and the light source, which is enough to prevent the operational button from being in contact with the light source when the operational button is pushed. A problem with the related art switching device is therefore that it is necessary to leave some distance between the operational button and the light source according to the two above-mentioned constraints, and hence the whole of the related art switching device increases in size.

A problem with the switching device disclosed in patent reference 1 is that since the light emitting unit is disposed on the lateral surface of the light guiding plate and hence the distance between the light guiding plate, which is integral with the key-top portion, and the light source changes as the key-top portion disposed as the operational button is pushed, the brightness of the key-top portion changes every time the key-top portion is operated.

The present invention is made in order to solve the above-mentioned problems, and it is therefore an object of the present invention to provide a switching device in which an operational button has brightness that does not change when pushed and has uniform brightness over the whole surface thereof and in which space saving is provided in order to achieve a downsizing of the whole of the switching device.

DISCLOSURE OF THE INVENTION

In accordance with the present invention, there is provided a switching device provided with an operational button having a side which is supported so that the operational button can shake via a hinge, wherein a light emitting unit is arranged in a vicinity of the hinge and a light diffusion prism member for diffusively reflecting light emitted out of the light emitting unit toward the operational button is disposed.

As a result, since the light emitting unit is arranged in the vicinity of the hinge where the amount of displacement of the operational button in the direction in which the operational button shakes, the distance between the light emitting unit and the operational button can be reduced as much as possible, and therefore space saving can be provided and a downsizing of the whole of the switching device can be achieved as compared with a conventional case where the light emitting unit is arranged behind the back surface of the operational button. Furthermore, since the distance between the light emitting unit and the operational button hardly changes even when the operational button is pushed, the brightness of the operational button does not change at the time of the pushing operation of the operational button.

PREFERRED EMBODIMENTS OF THE INVENTION

In order to explain the invention in greater detail, the preferred embodiments of the invention will be explained below with reference to the accompanying figures.

Embodiment 1.

Figure 1:
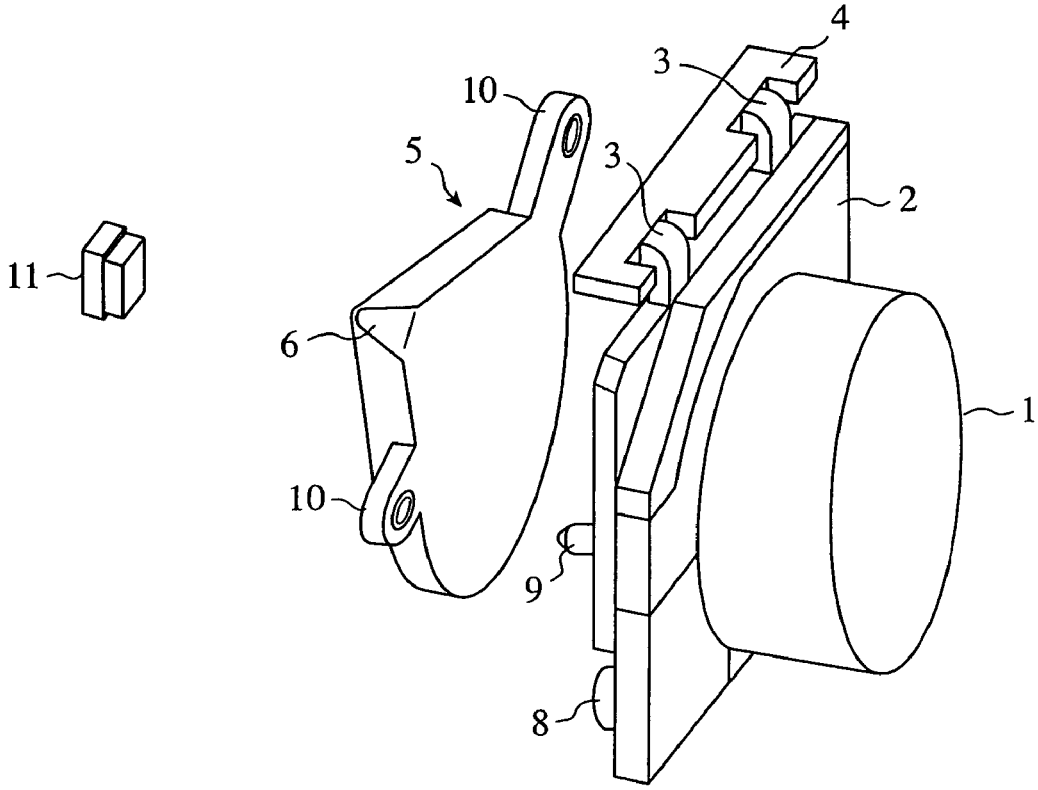
FIG. 1 is an exploded perspective view of a switching device in accordance with the present invention when viewed from the front thereof.
Figure 2:
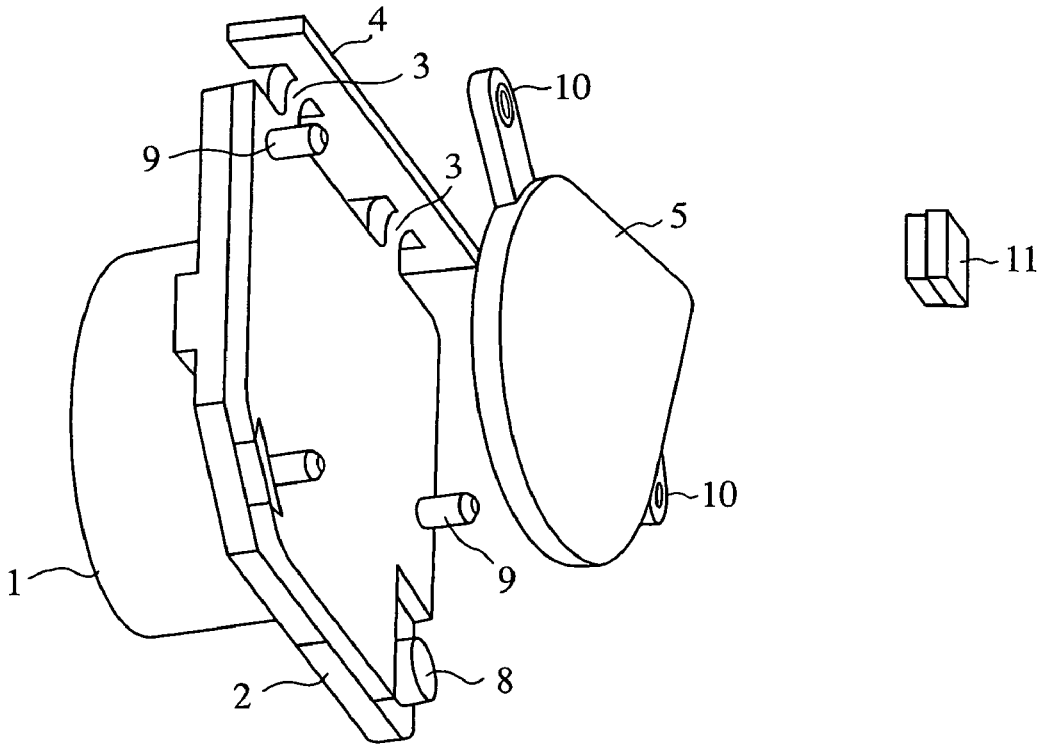
FIG. 2 is an exploded perspective view of the switching device when viewed from the back thereof.
Figure 3:
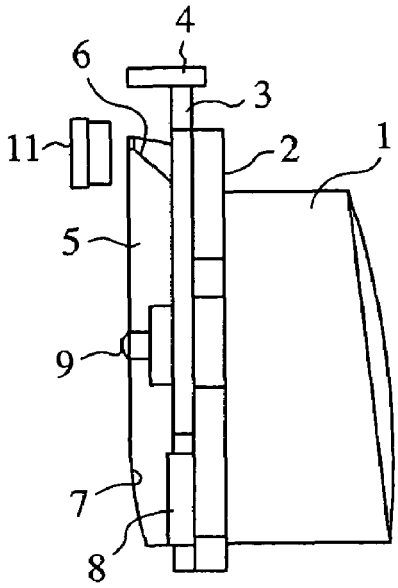
FIG. 3 is a side view of the switching device.
Figure 4:
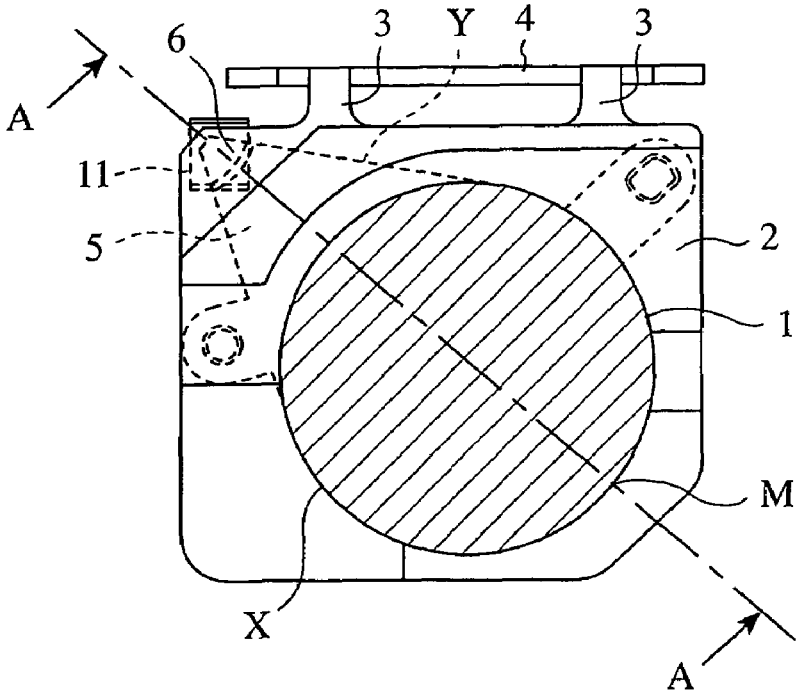
FIG. 4 is a plan view of FIG. 3.
Figure 5:
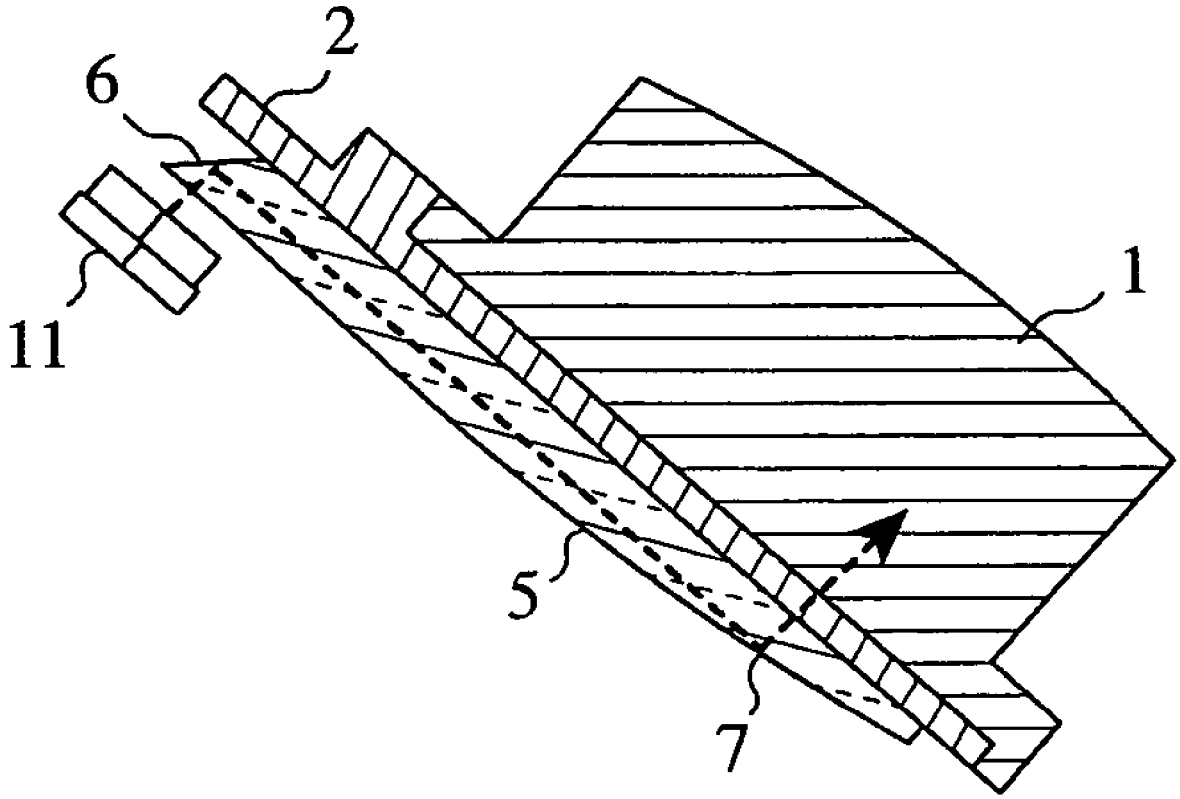
FIG. 5 is a cross-sectional view taken along the line A—A of FIG. 4.

FIGS. 1 and 2 are exploded perspective views of a switching device in accordance with the present invention, FIG. 3 is a side view of the switching device, FIG. 4 is a front view of FIG. 3, and FIG. 5 is a cross-sectional view taken along the line A—A of FIG. 4.

An operational button 1 is made of a transparent synthetic resin material in the shape of a column, such a cylinder as shown in the illustrated example, and a character string, a sign, or the like is marked on a front surface of the operational button 1. A surface of a shaking plate 2 which is made of a synthetic resin material through which light can pass is secured to a back surface of the operational button 1. A side of the shaking plate 2 is coupled to a holder 4 via a pair of thin hinges 3 which is formed of an elastic piece so that the shaking plate 2 can shake or swing. When the operational button 1 is pushed against an elastic force by the pair of thin hinges 3, the shaking plate 2 shakes or swings about the pair of thin hinges 3 while being inclined slightly.

A plate-shaped light diffusion prism member 5 is secured to a back surface of the shaking plate 2. This light diffusion prism member 5 is intended for diffusively reflecting incident light emitted out of a below-mentioned light emitting unit 11 and then guiding the light toward the operational button 1. The light diffusion prism member 5 has a plane shape which is assumed to be a compound shape in which the both ends of a semicircle arc X having a radius of curvature which is nearly equal to that of an arc of a circle showing the cross sectional shape of the operational button 1 are connected to the both ends of the base of an isosceles triangle Y, respectively, and the cross section of the operational button 1 is included in this compound shape, as shown in FIG. 4.

The light diffusion prism member 5 has a first reflecting surface 6 for guiding the incident light from the below-mentioned light emitting unit 11 toward the interior of the light diffusion prism member 5, and a second reflecting surface 7 for guiding the light reflected by the first reflecting surface 6 toward the operational button 1. The first reflecting surface 6 consists of an inclined surface which is formed by cutting off an apex portion of the isosceles triangle Y of the light diffusion prism member 5 and which is inclined towards a direction of a middle point M of the semicircle arc X.

On the other hand, the second reflecting surface 7 consists of an inclined surface which is formed by gradually reducing the thickness of the light diffusion prism member 5 with distance from the apex of the isosceles triangle Y toward the semicircle arc X of the light diffusion prism member 5, and which is inclined toward the first reflecting surface 6. The light diffusion prism member 5 is arranged with respect to the shaking plate 2 so that the first reflecting surface 6 is located in the vicinity of the pair of thin hinges 3 disposed on one side of the shaking plate 2.

A projecting portion 8 used for driving the switching device is formed on the back surface of the shaking plate 2 to which the light diffusion prism member 5 is secured and on another side of the shaking plate 2, i.e., at one end of the other side of the shaking plate 2 which is opposite to the side of the shaking plate 2 on which the pair of thin hinges 3 is disposed. This projecting portion 8 is brought into contact with a switch not shown when the operational button 1 is pushed. Two or more mounting shafts 9 for mounting the light diffusion prism member 5 protrude from arbitrary positions of the shaking plate 2, respectively. These mounting shafts 9 are engaged with holes of two or more mounting portions 10 which protrude from the lateral surface of the light diffusion prism member 5, respectively.

The light emitting unit 11 that illuminates the operational button 1 via the light diffusion prism member 5 is arranged in the vicinity of the pair of thin hinges 3 where the amount of displacement of the shaking plate 2 is the smallest when the operational button 1 is pushed. This is because when the light emitting unit 11 is thus arranged, the light emitting unit 11 can be close to the shaking plate 2 as much as possible while the amount of change in the distance between the light emitting unit 11 and the operational button 1 can be reduced even when the operational button 1 is pushed, so that the change in the brightness of the operational button which is caused by the pushing operation of the operational button 1 can be suppressed as much as possible.

To be more specific, the light emitting unit 11 is arranged on a side of the pair of thin hinges 3 disposed at one side of the shaking plate 2, and at a position where the light emitting unit 11 is not in contact with the light diffusion prism member 5 when the operational button 1 is pushed, and the light emitted out of the light emitting unit 11 can be incident upon the first reflecting surface 6 so as to be totally reflected by the first reflecting surface, and where the light emitting unit 11 faces the light diffusion prism member 5. It is understood that the location of the light emitting unit 11 is not limited to this example, and the light emitting unit 11 can be alternatively arranged in the vicinity of the other side of the shaking plate which is opposite to the above-mentioned side on which the pair of thin hinges 3 is disposed, for example.

Next, the operation of the switching device in accordance with this embodiment of the present invention will be explained.

After light emitted out of the light emitting unit 11 is perpendicularly incident upon the light diffusion prism member 5 and is diffusively reflected at a nearly right angle by the first reflecting surface 6, the light is further reflected diffusively at a nearly right angle by the second reflecting surface 7 and is then incident upon the operational button 1, as shown in FIG. 5. Thus, since the light emitted out of the light emitting unit 11 is guided to the operational button 1 via the light diffusion prism member 5, the whole of the surface of the operational button 1 can be uniformly illuminated, as shown by sloped lines of FIG. 4.

When the operational button 1 is pushed now against the elastic force by the pair of thin hinges 3 in order to drive the switch not shown, the shaking plate 2 shakes while being inclined slightly. The amount of displacement of the shaking plate 2 increases with distance from the pair of thin hinges 3, whereas the amount of displacement of the shaking plate 2 is very small in the vicinity of the pair of thin hinges 3. For this reason, since the distance between the light diffusion prism member 5 and the light emitting unit 11 hardly changes, the change in the brightness of the operational button which is caused by the pushing of the operational button can be suppressed as much as possible. When the operational button 1 is pushed, the projecting portion 8 disposed on the shaking plate 2 is brought into contact with the switch not shown so that the switch is driven.

As mentioned above, in accordance with this embodiment 1, since the light emitting unit is arranged in the vicinity of the pair of hinges that enables the operational button to shake, the distance between the light emitting unit and the operational button can be reduced as much as possible, and therefore space saving can be provided and a downsizing of the whole of the switching device can be achieved. Furthermore, since the distance between the light emitting unit and the operational button hardly changes even when the operational button is pushed, the brightness of the operational button does not change at the time of the pushing operation of the operational button. In addition, since the light diffusion prism member is formed of a planar body, it can be thinned and is therefore effective for a downsizing of the whole of the switching device.

Furthermore, since the light diffusion prism member is provided with the first and second reflecting surfaces which diffusively reflect the light emitted out of the light emitting unit toward the operational button, the operational button can be uniformly illuminated by the light emitted out of the light emitting unit without any unevenness of the brightness of the operational button. In addition, since the light emitting unit is arranged on one side of the pair of hinges that supports the shaking plate to which the light diffusion prism member is coupled so that the shaking plate can shake, the change in the distance between the light emitting unit and the operational button can be reduced when the operational button is pushed, and therefore the change in the brightness of the operational button which is caused by the pushing of the operational button can be reduced as much as possible.

INDUSTRIAL APPLICABILITY

As can be seen from the above description, the switching device in accordance with the present invention is suitable for button switching equipment using hinges which is mounted in vehicle-mounted equipment.

The invention claimed is:

1. A switching device comprising:

an operational button;

a hinge;

a light emitting unit that applies light to said operational button, said operational button having a side which is supported so that said operational button swings via said hinge, said light emitting unit being arranged in a vicinity of said hinge;

a light diffusion prism member which diffusively reflects the light emitted out of said light emitting unit toward said operational button; and a shaking plate;

wherein said operational button is coupled to said shaking plate, said shaking plate has a side that is supported by said hinge so that said shaking plate swings and said light diffusion prism member is coupled to another surface of said shaking plate, and said light emitting unit is arranged at a position where said light emitting unit faces the side of said shaking plate that is supported by said hinge.

2. The switching device according to claim 1, wherein said light diffusion prism member is formed of a plate body, and said light emitting unit is arranged so that the light emitted out thereof can be perpendicularly incident upon said light diffusion prism member.

3. The switching device according to claim 1, wherein said light diffusion prism member has a first reflecting surface for guiding light incident thereupon from said light emitting unit toward an interior of said light diffusion prism member, and a second reflecting surface for guiding the light reflected by said first reflecting surface toward said operational button.

4. The switching device according to claim 1, wherein said light diffusion prism member is configured so that the light enters said light diffusion prism member at a top portion thereof and travels downwardly to be reflected by an angled surface of said light diffusion prism member, towards said operational button.

5. The switching device according to claim 1, wherein said hinge is disposed at an outer peripheral area of said light diffusion prism member.

6. The switching device according to claim 1, wherein said light emitting unit opposes a corner portion of said light diffusion prism member.

7. The switching device according to claim 1, wherein said light emitting unit is offset from an x-axis and y-axis of said light diffusion prism member, wherein said x-axis and said y-axis lie in a plane which is parallel to said light diffusion prism member.

8. The switching device according to claim 1, wherein said light diffusion prism member has a thickness which is reduced in a direction extending away from said light emitting unit.

* * * * *